US005127457A

United States Patent [19]

Stewart et al.

[11] Patent Number: 5,127,457

[45] Date of Patent: Jul. 7, 1992

[54] METHOD AND WELL SYSTEM FOR PRODUCING HYDROCARBONS

[75] Inventors: Robert B. Stewart; Anthony P. King, both of GD Rijswijk, Netherlands

[73] Assignee: Shell Oil Company, Houston, Tex.

[21] Appl. No.: 658,122

[22] Filed: Feb. 20, 1991

[30] Foreign Application Priority Data

Feb. 20, 1990 [GB] United Kingdom ..... 9003758

[51] Int. Cl.[5] ..... E21B 43/16; E21B 43/24

[52] U.S. Cl. ..... 166/306; 166/50; 166/279; 166/303; 166/313

[58] Field of Search ..... 166/50, 191, 279, 285, 166/303, 304, 306, 313; 175/61

[56] References Cited

U.S. PATENT DOCUMENTS

| | | | |
|---|---|---|---|
| 1,816,260 | 7/1931 | Lee | 166/50 X |
| 2,171,416 | 8/1939 | Lee | 166/50 X |
| 2,365,591 | 12/1944 | Ranney | 166/306 X |
| 3,064,729 | 11/1962 | Linley | 166/306 X |
| 3,159,214 | 12/1964 | Carter | 166/306 X |
| 3,497,011 | 2/1970 | Weber et al. | 166/306 |
| 3,938,592 | 2/1976 | Aladiev et al. | 166/299 |
| 4,022,279 | 5/1977 | Driver | 166/306 X |
| 4,109,722 | 8/1978 | Widmyer et al. | 166/281 |
| 4,109,723 | 8/1978 | Widmyer | 166/303 |
| 4,362,213 | 12/1982 | Tabor | 166/267 |
| 4,460,044 | 7/1984 | Porter | 166/50 X |
| 4,646,836 | 3/1987 | Goodhart | 166/50 X |
| 4,878,539 | 11/1989 | Anders | 166/50 X |
| 4,982,786 | 1/1991 | Jennings, Jr. | 166/50 |

FOREIGN PATENT DOCUMENTS

| | | | |
|---|---|---|---|
| 1072442 | 2/1980 | Canada | 166/50 |
| 2041042A | 9/1980 | United Kingdom . | |
| 2066333A | 7/1981 | United Kingdom . | |
| 2149837A | 6/1985 | United Kingdom . | |
| 2194572A | 3/1988 | United Kingdom . | |

*Primary Examiner*—George A. Suchfield

[57] ABSTRACT

Fluids such as steam, water, foam, or chemical inhibitors which prevent scale or asphalt deposition are injected into or drawn from the reservoir formation near the intake zone of a production well via at least one fluid transfer leg which protrudes at a downhole location away from the production well into the reservoir formation.

5 Claims, 3 Drawing Sheets 27
26
29
28
20
20A 20B
22
31
30
22
23
21
21A 21B
32
24
25

METHOD AND WELL SYSTEM FOR PRODUCING HYDROCARBONS

FIELD OF THE INVENTION

This invention pertains to a method and a well system for producing hydrocarbons from a subterranean reservoir formation.

BACKGROUND OF THE INVENTION

During the recovery of hydrocarbons such as oil and gas from a reservoir formation via a production well the productivity of the well may be impaired due to formation plugging and erosion of the reservoir formation in the region of the well intake zone. In this region a large pressure drawdown of the produced fluids takes place while the velocity of these fluids through the pores of the formation is high. Under these circumstances precipitation and deposition of asphalt, heavy crude fractions, scale, salt, or sulphur may eventually lead to a large reduction in well productivity. The large pressure drawdown may further give rise to water coning, which implies that water is sucked up from a water bearing layer underneath the reservoir formation.

It is known to inject fluids, such as steam, water, solvents, and chemical inhibitors, via the production well into the well intake zone in order to alleviate production problems. These fluids may be injected via the production tubing of the well into the surrounding formation after interruption of the production operations.

It is also know that these fluids may be injected via a separate passageway in the production well to a location above the well intake zone where the fluids are injected into the surrounding formation and are expected to migrate through the formation to the well intake zone. U.S. Pat. Nos. 4,109,722, 4,109,723, and 4,362,213 disclose well systems where fluids are pumped down into the well via the annular space around the production tubing and subsequently injected into the surrounding formation via perforations in the well casing above the well intake zone. The '772 patent mentions that the depth of penetration of the injected fluid can be increased by forming an impermeable cement barrier in the formation pores around the well between the location where the fluids are injected and the well intake zone.

It is known from British patent application No. 2,194,572 to separate in a downhole separator water from crude oil and to reinject the separated water into an underlying water bearing layer via a water recirculation leg. This know well configuration does not allow injection of a special treatment or flushing fluid into the formation or to avoid water coning since the water recirculation does not result in a net water removal from the formation.

A disadvantage of the injection of fluid above the well intake zone is that the injected fluid will tend to seek the shortest path through the reservoir formation toward the underlying well intake zone so that the fluids only reach the upper part of this zone.

It is an object of the present invention to provide a method and well system for producing hydrocarbons which alleviate the problems associated with the prior art production techniques.

SUMMARY OF THE INVENTION

This and other objects of this invention are accomplished by a method comprising the steps of: drilling a production well into a reservoir formation; drilling a fluid transfer leg at a downhole location away from the production well; producing a hydrocarbon fluid via the production well; and transferring another fluid between the wellhead of the production well, the fluid transfer leg, and the reservoir formation.

The well system according to the invention comprises: a production well extending into a reservoir formation; a fluid transfer leg which protrudes at a downhole location away from the production well; means for producing a hydrocarbon fluid through the production well; and means for transferring another fluid between the wellhead of the production well, the fluid transfer leg, and the reservoir formation.

DETAILED DESCRIPTION OF THE INVENTION

Figure 1:
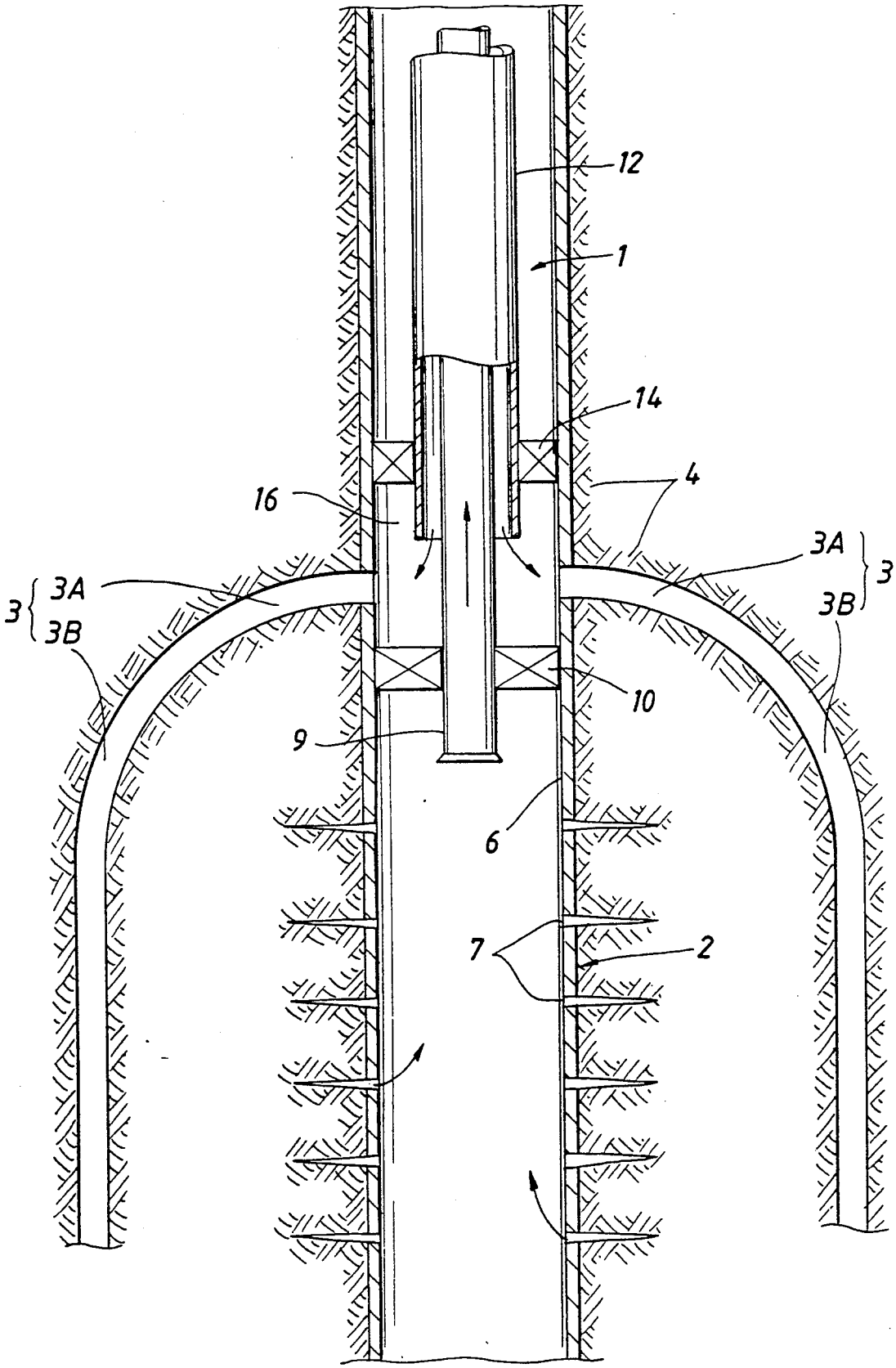
FIG. 1 illustrates a well system according to the invention having fluid transfer legs arranged in a birdcage configuration.

FIG. 1 shows a longitudinal sectional view of an oil production well 1 having a well intake zone 2 around which a series of fluid injection legs 3 are drilled in a birdcage configuration into the surrounding reservoir formation 4.

The production well 1 contains a well casing 6 in which a series of perforations 7 are shot in the region of the well intake zone 2 to enable inflow of oil into the well. A production tubing 9 is suspended within the well 1 and a first packer 10 seals off the annular space formed between the production tubing 9 and the well casing 6 just above the well intake zone 2.

A fluid injection tubing 12 is arranged coaxially around the production tubing 9 such that the lower end of the injection tubing 12 is located above the first packer 10. A second packer 14 seals off the annular space formed between the injection tubing 12 and the casing at a location just above the lower end of the injection tubing 12. In this manner a fluid injection chamber 16 is formed between the two packers 10 and 14 from which chamber 16 the injection legs 3 protrude into the reservoir formation 4.

The injection legs 3 may be drilled into the formation 4 using a jet drilling technique which allows to drill the injection wells to be drilled laterally away from the production well 1 such that each injection leg 3 has a radial upper section 3A and an axial lower section 3B which is substantially parallel to the intake zone 2 of the production well 1.

The injection legs 3 (two of which are shown) are drilled at regular angular intervals from the injection chamber 16 into the formation 4 so that these injection legs 3 form a "bird cage" system of injection legs around the intake zone 2 of the production well 1.

During operation of the well 1 formation fluids enter the intake zone 2 of the production well 1 via the perforations 7 and are subsequently transferred to the earth surface via the production tubing 9.

If production problems due to chemical and/or physical impairment of the reservoir formation 4 around the well intake zone 2 occur or are envisaged fluid is injected via the injection tubing 12, injection chamber 16, and injection legs 3 into the formation. The bird cage configuration of the injection legs 3 around the intake zone 2 ensures an equal distribution of the injected fluid across this zone 2 when the injected fluid is produced with the crude oil via the production well 1.

The injected fluid may contain steam to heat the produced oil and decrease its viscosity. The fluid may also contain chemical solvents and inhibitors to prevent asphalt and scale deposition.

It will be understood that instead of the bird cage configuration of a plurality of injection legs, a single injection leg may be drilled adjacent to the intake zone of the production well. This single injection leg may have a coiled shape around the intake zone of the production well to facilitate an even distribution of injection fluid into the reservoir formation around the intake zone of the production well.

Figure 2:
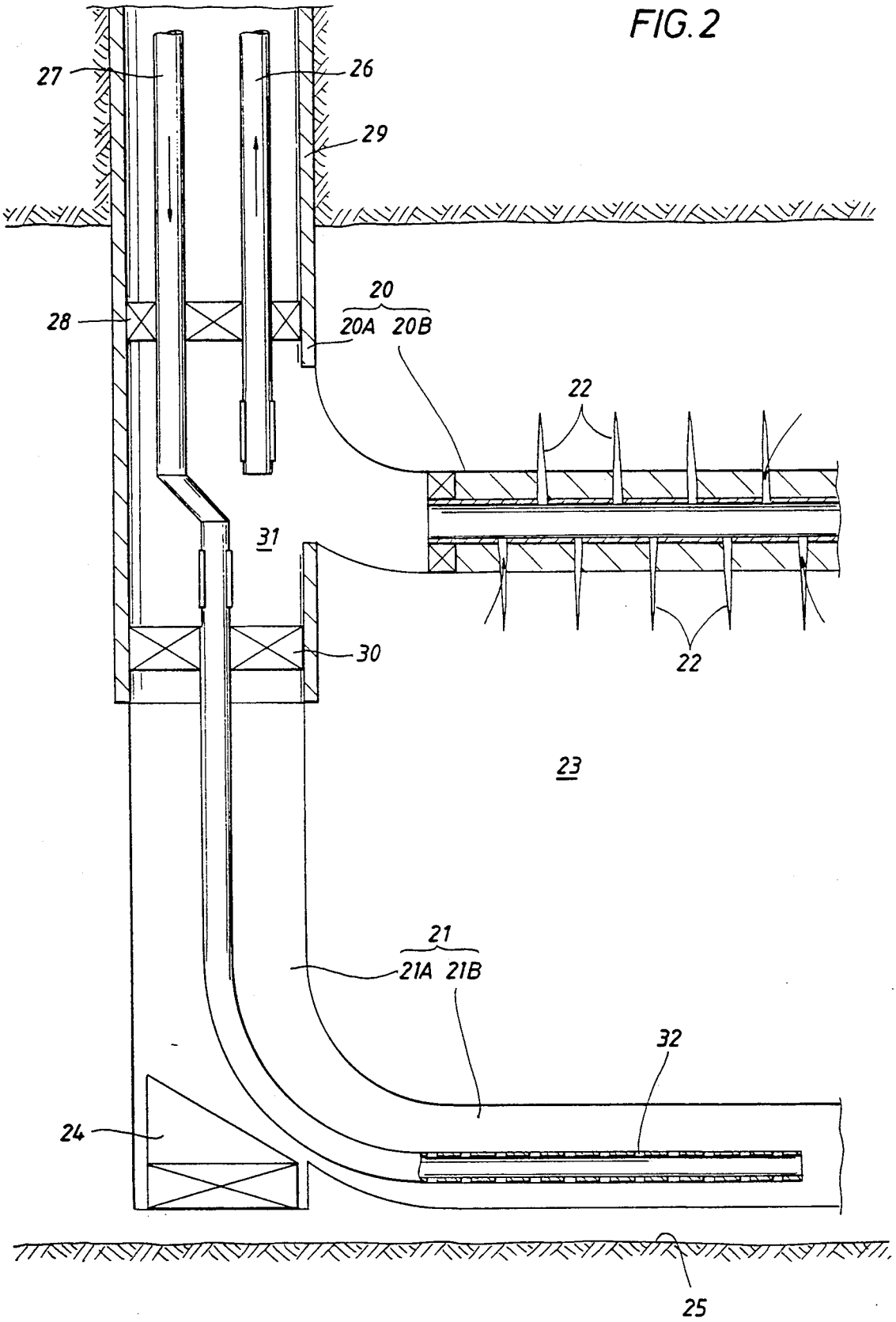
FIG. 2 illustrates a well system having a double-L configuration.

FIG. 2 shows a well system where the production well 20 and the fluid transfer leg 21 are arranged into a double-L configuration.

The production well comprises a vertical upper section 20A and a substantially horizontal lower section 20B having a well intake zone in which perforations 22 have been shot to facilitate inflow of hydrocarbons from the surrounding reservoir formation 23 into the well 20.

The upper section 21A of the fluid transfer leg extends in downward direction away from the production well 20 whereas its lower section 21B is oriented parallel to the lower section 20B of the production well.

The horizontal lower section 21B of the fluid transfer leg 21 has been drilled away from its vertical upper section by placing a deviation shoe 24 at the bottom of the vertical wellbore so that the drilling assembly is deflected in horizontal direction near the lower boundary 25 of the reservoir formation 23. The horizontal lower section 20B of the production well 20 has been drilled in a similar manner with the exception that the deviation shoe for deflecting the drilling assembly into this lower section 20B has been removed or milled out after completion of this section 20B.

The upper section 20A of the production well contains a production tubing 26, a fluid injection tube 27, and a packer 28 which seals off the wellbore between the tubing 26, tube 27, and the well casing 29 just above the offtake of the lower well section 20B. The injection tube 27 extends into the transfer leg 21 via a packer 30 which is located just below this offtake.

The lower end of the production tubing 26 is located in the area 31 of the well between the packers. The lower end of the injection tube 27 is connected to a slotted liner 32 via which a treatment fluid can be injected into the surrounding reservoir formation 23.

If during production of oil via the production well 20 difficulties with precipitation of deposits in the reservoir formation 23 near the well intake zone is foreseen a treatment fluid is injected via the injection tube 27 into the formation 23 such that it migrates through the formation toward the intake zone of the production well 20.

The injected treatment fluid may contain water, foam, steam, chemical agents which dissolve precipitated deposits or agents which improve the bond between formation particles to avoid erosion of the reservoir formation. The injected fluid may also contain a treated fraction of the produced hydrocarbons which fraction has such a composition that it dissolves precipitated deposits.

Figure 3:
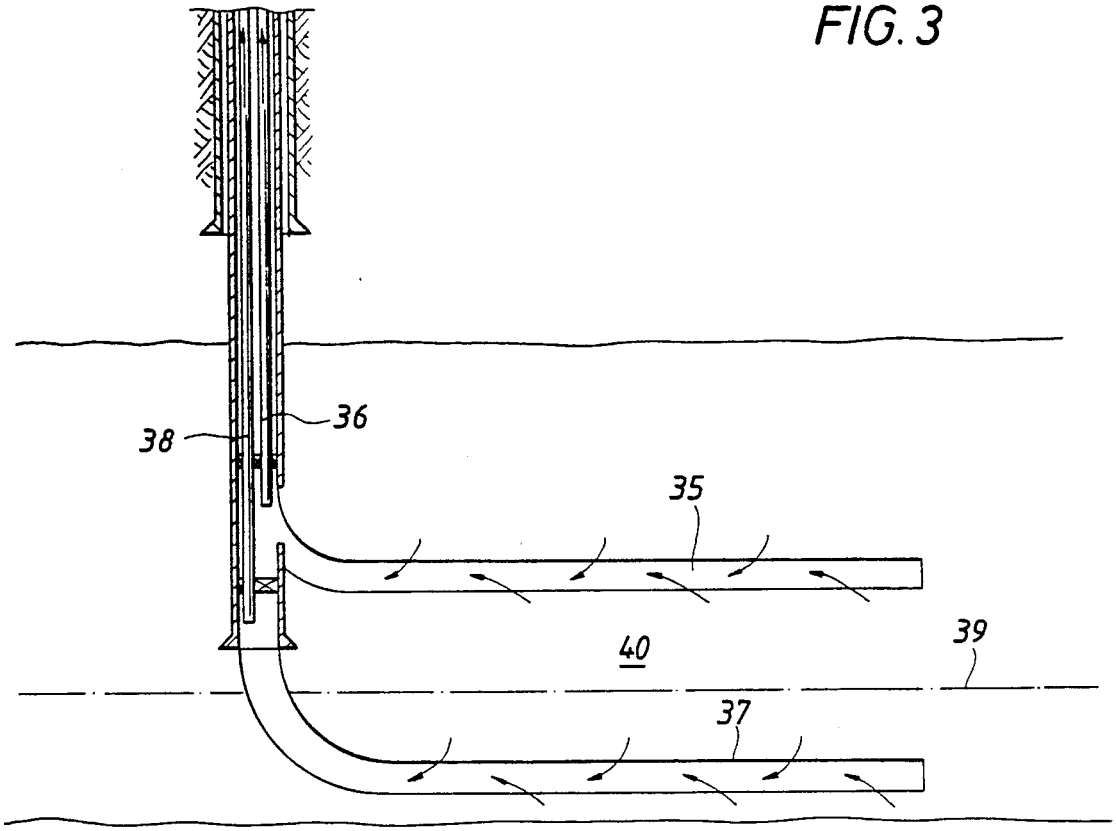
FIG. 3 shows a double-L well system.

FIG. 3 shows a double-L well system where oil is produced via the horizontal lower well section 35 into the production tubing 36 whereas water is produced into a fluid transfer tube 38 via the horizontal lower section of the fluid transfer leg 37.

The purpose of the production of water via this leg 37 is to avoid "water coning," or in other words, to avoid that the oil-water interface 39 reaches the intake zone of the lower well section 35.

If required, the production of water via the fluid transfer leg 37 may be interrupted if the oil-water interface 39 has sunken deep enough. Then treatment fluid may be injected into the reservoir formation 40 in the same manner as described with reference to FIG. 2. This treatment fluid may contain chemicals which form an impermeable barrier to delay the further progress of water toward the well intake.

It will be understood that a double-L well system with a fluid transfer leg above the horizontal lower section of the production well may be used if mixing of gas from a gas cap above the oil reservoir is to be avoided.

Figure 4:
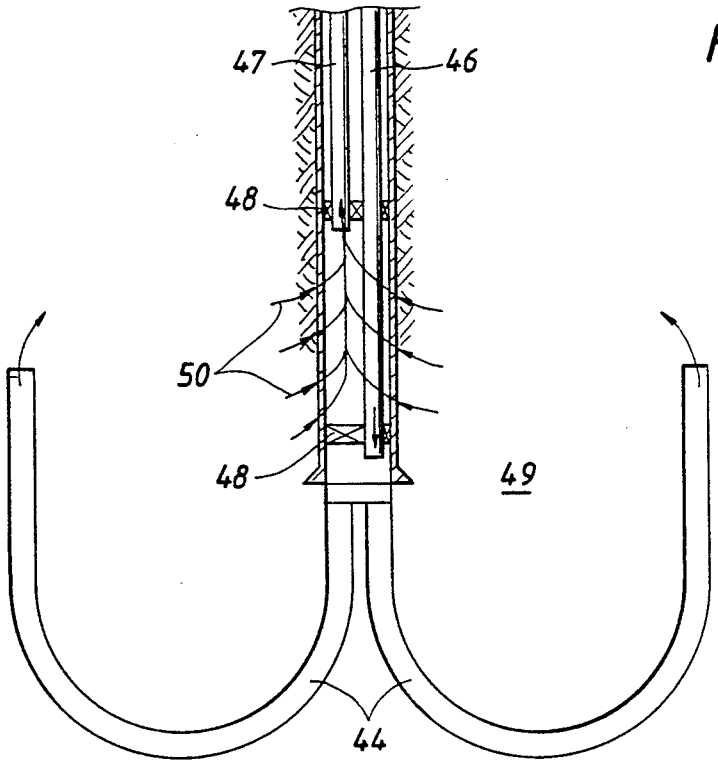
FIG. 4 illustrates a well system having fluid transfer legs arranged in an umbrella configuration.

FIG. 4 shows a well system wherein fluid transfer legs 44 are arranged in an inverted umbrella configuration around the intake zone of an oil production well.

An assembly of an injection tube 46, production tubing 47, and packers 48 facilitate injection of fluid into the reservoir formation 49 simultaneously with production of oil via the perforated well intake zone 50.

It is observed that the fluid injection tube could be a temporarily installed coiled tubing which is retrieved from the well after a batch of treatment fluids have been injected into the reservoir formation via the fluid transfer leg or legs. Fluid may be transferred via the fluid transfer leg during a period that no hydrocarbon fluid is produced via the production well.

Numerous other modifications of the well system configurations depicted in the accompanying drawings will become apparent to those skilled in the art. Accordingly it is to be clearly understood that the embodiments of the well system shown in the drawings are exemplary only.

We claim:

1. A well system for producing hydrocarbons from a subterranean reservoir formation comprising:

a production well extending into the reservoir formation;

a fluid transfer leg which protrudes, from a downhole location away from the production well adjacent to an intake zone of the production well;

means for producing a hydrocarbon fluid through the production well that include a production tubing which is in fluid communication with the intake zone; and means for transferring another fluid between the wellhead of the production well, the fluid transfer leg, and the reservoir formation comprising a fluid injection tubing having an upper section which is arranged parallel to the production tubing within the production well and a perforated lower section which extends through the fluid transfer legs.

2. The well system of claim 1 wherein the production well has a substantially horizontal intake zone and the fluid transfer leg has a lower section which is substantially parallel to and located below said intake zone.

3. The well system of claim 1 wherein a plurality of fluid transfer legs are arranged in a birdcage configuration around an intake zone of the production well.

4. The well system of claim 1 wherein a plurality of fluid transfer legs are arranged in an umbrella configuration around an intake zone of the production well.

5. A method for producing hydrocarbons from a subterranean reservoir formation, the method comprising the steps of:

drilling a production well into the reservoir formation;

drilling a fluid transfer leg at a downhole location away from the production well and below and adjacent to the intake zone of the production well;

producing a hydrocarbon fluid via the production well; and alternating between transferring another fluid from the wellhead of the production well to the fluid transfer leg and then to the reservoir formation and producing pore water from the fluid transfer leg.

* * * * *